US010308398B2

(12) United States Patent
Miller

(10) Patent No.: US 10,308,398 B2
(45) Date of Patent: Jun. 4, 2019

(54) PRINTING APPARATUS FOR PRINTING PLASTIC FOOD BAGS

(71) Applicant: Bizerba USA Inc., Joppa, MD (US)

(72) Inventor: David Miller, Troy, OH (US)

(73) Assignee: BIZERBA USA INC., Joppa, MD (US)

( * ) Notice: Subject to any disclaimer, the term of this patent is extended or adjusted under 35 U.S.C. 154(b) by 0 days.

(21) Appl. No.: 15/911,195

(22) Filed: Mar. 5, 2018

(65) Prior Publication Data

US 2018/0186516 A1 Jul. 5, 2018

Related U.S. Application Data

(62) Division of application No. 14/983,582, filed on Dec. 30, 2015, now abandoned.

(51) Int. Cl.

| | |
|---|---|
| ***B41J 2/32*** | (2006.01) |
| ***B41J 15/16*** | (2006.01) |
| ***B65D 33/00*** | (2006.01) |
| ***B41J 11/00*** | (2006.01) |
| ***B65H 23/26*** | (2006.01) |
| ***B41J 3/407*** | (2006.01) |

(52) U.S. Cl.

CPC ..... *B65D 33/004* (2013.01); *B41J 3/407* (2013.01); *B41J 11/0005* (2013.01); *B65D 33/002* (2013.01); *B65H 23/26* (2013.01)

(58) Field of Classification Search

CPC ..... B65H 23/16; B65H 23/26; B65H 57/02; B65H 23/34; B65H 23/035; B65D 33/004; B65D 33/04; B65D 33/002; B41J 11/0005; B41J 11/0045; B41J 29/13; B41J 29/02; B41J 15/046; B41J 15/165; B41J 15/16

USPC ..... 400/120.01, 120.16, 120.17, 583, 611, 400/613, 621, 634, 636, 642, 691, 692, 400/693; 347/171, 197, 198, 218, 219, 347/221, 222

See application file for complete search history.

(56) References Cited

U.S. PATENT DOCUMENTS

| | | | |
|---|---|---|---|
| 4,428,134 | A | 1/1984 | Arnold et al. |
| 4,709,398 | A | 11/1987 | Ausnit |
| 4,849,090 | A | 7/1989 | Case et al. |
| 4,904,092 | A | 2/1990 | Campbell et al. |
| 5,167,301 | A | 12/1992 | Cappi et al. |
| 5,468,080 | A | 11/1995 | Jones |
| 6,003,669 | A | 12/1999 | Baricevic |
| 6,159,136 | A | 12/2000 | Belias et al. |

(Continued)

*Primary Examiner* — Leslie J Evanisko

(74) *Attorney, Agent, or Firm* — Leydig, Voit & Mayer, Ltd.

(57) ABSTRACT

A printing apparatus for printing on continuous plastic food bags, each of the continuous plastic food bags containing a printable area integrated in a plastic foil thereof, includes: a plastic food bag holder for holding the continuous plastic food bags; a plastic food bag guiding mechanism for guiding the continuous plastic food bags from the plastic food bag holder in the direction of a plastic food bag printer, the plastic food bag printer including a printhead for direct thermal printing onto the printable area of each of the continuous plastic food bags; a plastic food bag transporting mechanism for pulling the continuous plastic food bags through the plastic food bag guiding mechanism towards the plastic food bag printer; and a plastic food bag ejector for detaching an individual plastic food bag from the continuous plastic food bags.

22 Claims, 7 Drawing Sheets

(56) References Cited

U.S. PATENT DOCUMENTS

| | | | | |
|---|---|---|---|---|
| 6,284,177 | B1 | 9/2001 | Ewing | |
| 6,407,034 | B1 | 6/2002 | Ewing | |
| 6,601,370 | B2 | 8/2003 | Colombo et al. | |
| 6,789,963 | B2 * | 9/2004 | Brahier | B65B 43/123 347/197 |
| 6,810,641 | B2 * | 11/2004 | Ausnit | B65B 61/188 493/213 |
| 6,857,455 | B2 * | 2/2005 | Brahier | B41J 3/4073 141/10 |
| 7,806,361 | B2 * | 10/2010 | Sato | B65H 16/02 242/595 |
| 7,952,598 | B2 * | 5/2011 | Rawlings | B41J 29/17 347/171 |
| 2005/0161512 | A1 | 7/2005 | Jones et al. | |
| 2007/0269740 | A1 | 11/2007 | Blank et al. | |
| 2009/0169282 | A1 | 7/2009 | Keeton | |
| 2009/0284576 | A1 * | 11/2009 | Sekino | B41J 3/60 347/222 |
| 2013/0098799 | A1 | 4/2013 | Iwasaki et al. | |
| 2014/0079894 | A1 | 3/2014 | Buchbinder et al. | |
| 2015/0210045 | A1 | 7/2015 | Koike et al. | |

* cited by examiner

PRINTING APPARATUS FOR PRINTING PLASTIC FOOD BAGS

CROSS-REFERENCE TO RELATED APPLICATIONS

This patent application is a divisional of U.S. patent application Ser. No. 14/983,582, filed on Dec. 30, 2015, now abandoned, the entire disclosure of which is hereby incorporated by reference herein.

FIELD

The present invention relates to plastic food bags that are printable, a printer for such plastic food bags and a method for operating the printer and printing individual information on the plastic food bag.

BACKGROUND

Plastic food bags or deli bags are used in supermarkets and retail stores for packaging a small number of items, for example fresh food at the cheese or meat counter. A label is printed and attached to the plastic food bag. The label is either a self-adhesive label which is glued on the plastic food bag or is a label which is attached to the plastic food bag by means of a staple.

U.S. Pat. No. 5,468,080 describes a poly bag printer for a packaging machine for the production of printed plastic food bags.

U.S. Pat. No. 6,284,177 B1 describes a printable media formed out of polyethylene or polypropylene for the use as a printing media for a checkout receipt reflecting the sale of goods to a customer.

All known methods involve a significant effort at the sales counter with many steps to be executed by a sales person.

SUMMARY

In an embodiment, the present invention provides a printing apparatus for printing on continuous plastic food bags, each of the continuous plastic food bags containing a printable area integrated in a plastic foil thereof, the printer apparatus comprising: a plastic food bag holder for holding the continuous plastic food bags; a plastic food bag guiding mechanism for guiding the continuous plastic food bags from the plastic food bag holder in the direction of a plastic food bag printer, the plastic food bag printer comprising a printhead configured for direct thermal printing onto the printable area of each of the continuous plastic food bags; a plastic food bag transporting mechanism for pulling the continuous plastic food bags through the plastic food bag guiding mechanism towards the plastic food bag printer; and a plastic food bag ejector configured to detach an individual plastic food bag from the continuous plastic food bags.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
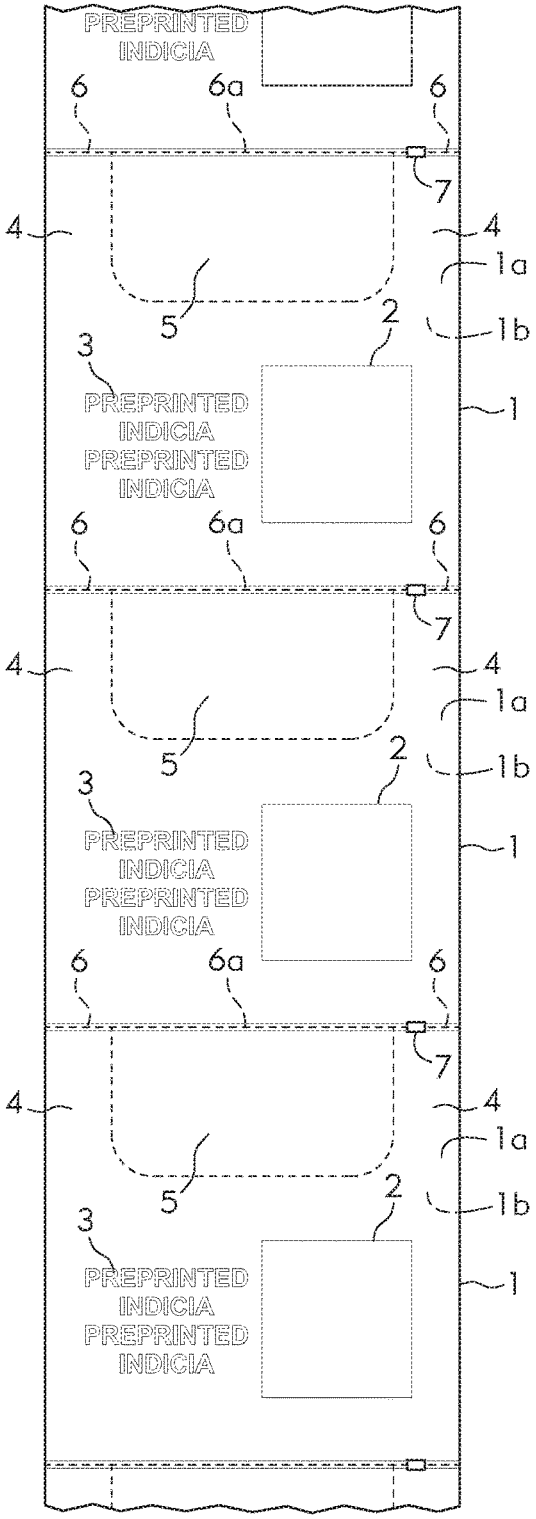
FIG. 1 schematically depicts continuous plastic food bags according to the invention.

The present invention concerns plastic food bags. A plastic food bag is formed of a first plastic foil. This foil forms one side of the bag. A second plastic foil forms the opposite side of the bag. The first foil and the second foil are on top of each other when the bag is lying on one side. The first foil and the second foil are continuously merged together at three edges to form the plastic food bag, i.e., three edges of the first and the second plastic foil are sealed together to form the plastic food bag.

According to one embodiment, the first and the second foil are made of thermoplastic material. According to one embodiment, the plastic food bags are produced by an extruder and the thermoplastic material is provided in the form of a long thin hose which is formed to a bag by applying seals in a direction perpendicular to the axis of the hose in regular intervals. By folding the hose in a lengthwise direction before sealing, the bag is formed and can be considered as a first foil and a second foil which are continuously merged together. According to one embodiment, the bags are folded in a lengthwise direction such that a small part of the plastic material is folded between the first and second plastic foil and provides a side part of the plastic food bag when the plastic food bag is in use. The bags are not cut completely at the seal during production but are provided as continuous plastic food bags which are attached to each other and are detachable at a perforation.

According to one embodiment, the first foil contains an area which is printable. The possibility to print on the printable area is still given after the production of the plastic food bag is finished, meaning that the plastic food bag does not necessarily need to be printed during production of the plastic food bag, but could instead be printed afterwards, e.g., in a retail store, such as at a point of sale, in which the plastic food bag is used and provided to a costumer.

According to one embodiment, the printable area is used to print information on each plastic food bag individually. Not all plastic food bags need to be printed with the same information. One example of a plastic food bag is a deli bag. According to one embodiment, the printable area is a small part of the first foil of the plastic food bag, e.g., in the center or at a corner. According to one embodiment, the printable area covers a significant part of the first foil of the plastic food bag. According to one embodiment, the first foil and the second foil of the plastic food bag contain printable areas that do not overlap when the plastic food bag is empty.

According to one embodiment, the plastic food bag has preprinted areas besides the printable area as described above. According to one embodiment, a part of the printable area as described above is preprinted. Preprinted means that a print is applied to the plastic food bags during production and is mainly identical on all plastic food bags of continuous plastic food bags. The preprinting is not done in a retail store.

According to one embodiment, the printable area is an area for direct thermal printing. According to one embodiment, the printable area is an area for thermal transfer printing. According to one embodiment, the printable area is an area for ink jet printing.

According to one embodiment, multiple plastic food bags are attached to each other and are detachable at a perforation between two neighboring plastic food bags. Continuous plastic food bags are plastic food bags that are attached to each other. Continuous plastic food bags are a packet of plastic food bags. According to one embodiment, continuous plastic food bags are zig-zag folded and are thus provided as a block of multiple plastic food bags. According to one embodiment, continuous plastic food bags are coiled up on a roll of plastic food bags. Continuous plastic food bags may be inserted as a packet, e.g., as a roll or a block, in a printer and may be printed one after another while a chain made from continuous plastic food bags passes through the printer. After printing, the plastic food bags are detachable from each other by means of the perforation.

According to one embodiment, the printable area comprises at least a base layer with a base coat. The base coat provides a background color, e.g., white for better readability of the content printed on the printable area. This is especially important if the plastic food bag is mainly made of transparent foils. The base coat can be understood as matting agent. Further, the printable area may comprise a middle layer with a thermosensitive material that changes color when heated. During direct thermal printing, the printhead heats the thermosensitive material causing the color of the thermosensitive material to change, e.g., to black, causing the printing to be readable. Further, the printable area may comprise a transparent top layer for coating the middle layer. The transparent top layer protects the printing layer. According to one embodiment, the printable area is for thermal transfer printing. Therefore, the printable area comprises at least an application layer on which the printing is applied by a thermal transfer printing head and a color ribbon for thermal transfer printing. According to one embodiment, the printable area is for ink jet printing. The printable area may therefore comprise at least an application layer on which ink is applied by an ink jet printhead.

According to one embodiment, the plastic food bag comprises a zipper at its open side. The first foil and second foil of the plastic food bag are continuous, i.e., merged at three edges, and have an open fourth edge. A zipper mechanism in provided at this fourth edge to close and reopen the plastic food bag. According to one embodiment, the zipper mechanism for closing and reopening the plastic food bag is provided in the form of weak adhesive. The plastic food bag can be closed by sticking the adhesive part on the opposite side of the plastic food bag and opened by a small force pulling the two foils away from each other.

According to one embodiment, the printable area is for printing at least one of a store address, a store logo, marketing information, a bar code, a price, a weight and ingredients for one or multiple items to be packed in the plastic food bag. The printable area of the plastic food bag is to be used as a substitute for a label and may provide the same information found on a traditional product label.

According to one embodiment, a printing apparatus for printing on a plastic food bag is proposed. The plastic food bag comprises a printable area integrated in one foil of the plastic food bag. The printing apparatus comprises a plastic food bag holder for holding multiple continuous plastic food bags. According to one embodiment, the plastic food bags are plastic food bags as described above. Continuous plastic food bags are multiple plastic food bags which are attached to each other as described above. The printing apparatus further comprises a plastic food bag guiding mechanism. The plastic food bag guiding mechanism is for guiding the continuous plastic food bags from the plastic food bag holder in the direction of a plastic food bag printer.

The printing apparatus comprises a plastic food bag transporting mechanism for pulling the continuous plastic food bags through the plastic food bag guiding mechanism towards the plastic food bag printer. The printing apparatus further comprises a plastic food bag printer for printing individual information onto the printable area of a plastic food bag and a plastic food bag ejector providing the empty and individually printed plastic food bag. According to one embodiment, the plastic food bag ejector has a separator for separating two continuous bags at the perforation between the two continuous bags. According to one embodiment, the separator comprises a metal ridge for detaching one bag from another. According to one embodiment, the separator is a knife that is electrically or pneumatically operated or that is mechanically operated by a user. According to one embodiment, the continuous bags have regularly arranged punched holes or a frame of regularly arranged punched holes for transporting the continuous bags by the plastic food bag transporting mechanism by at least one sprocket wheel. In one embodiment, the printer comprises multiple printheads for printing a printing area in the first foil on the one side of the plastic food bag and a printing area in the second foil on the other side of the plastic food bag.

According to one embodiment, the plastic food bag transporting mechanism comprises at least a first feed roller and a second feed roller. At least one of the first feed roller and the second feed roller is driven. According to one embodiment, both feed rollers are driven. The at least two feed rollers press against each other. According to one embodiment, the at least two feed rollers are made of a rubber like material with a certain static friction in order to pull the continuous plastic food bag. According to one embodiment, additionally or alternatively a sprocket wheel is used for pulling the continuous plastic food bags. The continuous plastic food bags are pulled through the plastic food bag guiding mechanism and through the plastic food bag printer. According to one embodiment, in the direction of movement of the plastic food bags, the plastic food bag transporting mechanism is arranged behind the plastic food bag guiding mechanism and the plastic food bag printer. According to one embodiment, the plastic food bag is then pushed in the direction of the plastic food bag ejector.

According to one embodiment, at least one of the first feed roller or the second feed roller contains a notch for passing through the plastic food bag locking mechanism. According to one embodiment, this notch is also for guiding the plastic food bag and keeping the plastic food bag locking mechanism, e.g. a zipper, at the right position when passing the notch. According to one embodiment, there is a guiding structure for guiding the zipper in the direction of the notch.

According to one embodiment, the plastic food bag printer comprises a data input for receiving individual data to be printed. Further, the plastic food bag printer comprises a printhead for printing the individual information on a printing area of a plastic food bag. Further, the plastic food bag printer comprises a guide roller for guiding the plastic food bag and pressing the plastic food bag against the printhead. According to one embodiment, the guide roller is a non-driven roller. According to one embodiment, the guide roller is a driven roller.

According to one embodiment, the plastic food bag guiding mechanism comprises at least two guide walls neighboring each other in a feeding direction of the continuous plastic food bags. The at least two guide walls are displaced to each other in a direction perpendicular to the feeding direction of the continuous plastic food bags, meaning that the endpoints of at least two guide walls provide a curved way through which the plastic food bags are pulled. This arrangement has the advantage that the continuous plastic food bags are well aligned due to the fact that they are pulled through a curved feeding line. According to one embodiment, the endpoints of the at least two guide walls are rounded edges in order not to break the continuous plastic food bags while they are pulled along the plastic food bag guiding mechanism. According to one embodiment, the plastic food bag guiding mechanism is a slot or chute through which the plastic food bag is guided. According to one embodiment, the plastic food bag guiding mechanism comprises one or more rollers guiding the plastic food bags.

According to one embodiment, the plastic food bag guiding mechanism comprises a first and a second upper guide wall and a first and a second lower guide wall. In a feeding direction of the continuous plastic food bags the walls are neighboring each other in the order of the first upper wall, the first lower wall, the second upper wall and the second lower wall, meaning that in a feeding direction of the plastic food bags there is an upper wall, a lower wall, an upper wall and a lower wall. Therefore, endpoints of the walls push the plastic food bags perpendicular to the feeding direction downwards, upwards, downwards and upwards in order to align them and avoid jams. The printhead and the guide roller are neighboring the second lower wall and the printhead is arranged below the guide roller. Therefore, the guide roller guides the continuous plastic food bags and pushes them in the direction of the printhead.

According to one embodiment, the plastic food bag guiding mechanism, the plastic food bag transporting mechanism and the printhead are mounted on a clamshell device. The upper part of the clamshell may include the first upper wall, the second upper wall, the guide roller and the first feed roller. The lower part of the clamshell may include the first lower wall, the second lower wall, the printhead and the second feed roller. This way, if a new set of continuous plastic food bags needs to be installed in the printing apparatus, the clamshell device is opened by an operator. The feeding path of the continuous plastic food bag is accessible to the operator and the operator is able put the continuous plastic food bags on top of the lower part of the clamshell device. By closing the clamshell device, the feeding line of the plastic food bag is established and the continuous plastic food bags are well included in the feeding path. This arrangement avoids the need to thread the continuous plastic food bags through the curved feeding line of the plastic food bags.

According to one embodiment, the plastic bag guiding mechanism comprises a first and a second upper guide wall and a first and a second lower guide wall. In a feeding direction of the continuous plastic bags the walls are neighboring each other in the order first lower wall, first upper wall, second lower wall and second upper wall, meaning that in a feeding direction of the plastic bags there is a lower wall, an upper wall, a lower wall and an upper wall. Therefore, endpoints of the walls push the plastic bags perpendicular to the feeding direction upwards, downwards, upwards and downwards in order to align them and avoid jams. The printhead and the guide roller are neighboring the second upper wall and the printhead is arranged above the guide roller. Therefore, the guide roller guides the continuous plastic food bags and pushes them in the direction of the printhead.

According to one embodiment, the plastic food bag guiding mechanism, the plastic food bag transporting mechanism and the printhead are mounted on a clamshell device. The upper part of the clamshell may include the first upper wall, the second upper wall, the printhead and the first feed roller. The lower part of the clamshell may include the first lower wall, the second lower wall, the guide roller and the second feed roller. This way, if a new set of continuous plastic food bags need to be installed in the printing apparatus, the clamshell device is opened by an operator. The feeding path of the continuous plastic food bags is accessible to the operator and the operator is able put the continuous plastic food bags on top of the lower part of the clamshell device. By closing the clamshell device, the feeding line of the plastic food bag is established and the continuous plastic food bags are well included in the feeding path. This arrangement avoids the need to thread the continuous plastic food bags through the curved feeding line of the plastic food bags.

According to one embodiment, a method for printing individual information on a plastic food bag is proposed. According to one embodiment, the plastic food bags are plastic food bags as described above. The method comprises providing by a plastic food bag holder with multiple continuous plastic food bags. The method further comprises a plastic food bag transporting mechanism pulling a plastic food bag though a plastic food bag guiding mechanism and a printer. The method further comprises the plastic food bag guiding mechanism arranging the plastic food bag to prepare the plastic food bag to be provided to a printer. The method further comprises the printer printing individual information on a printable area which is integrated in one foil of the plastic food bag.

According to one embodiment, the method as described above is performed in a retail store.

According to one embodiment, the individual information printed is at least one of a store address, a store logo, marketing information, a bar code, a price, a weight and ingredients for one or multiple items to be packed in the plastic food bag. FIG. 1 shows multiple plastic food bags 1 which stick to each other, i.e. which are continuous plastic food bags. It will be understood by a person skilled in the art that this picture is for exemplary purposes only and in fact a large number of plastic food bags 1 are used to build continuous plastic food bags 1. The plastic food bag 1 has a first foil 1*a*, a second foil 1*b* and a printable area 2 on which information can be printed after the production of the plastic food bag 1 is finished, i.e., the printing is done in a retail store. According to one embodiment, the plastic food bag 1 has a small handle 4 which is produced, for example, by cutting out an upper part 5 of the plastic food bag 1. Plastic food bag 1 may include a zipper 7 at the open edge of the plastic food bag 1. Zipper 7 may be used to close and reopen the plastic food bag 1. According to one embodiment, the plastic food bag 1 has a preprinted area 3 on which information (e.g., such as the "preprinted indicia" shown in FIGS. 1 and 3) is printed during production of the plastic food bag 1 (i.e., prior to additional information being printed on the plastic food bag 1 at a later point, such as in a retail store). According to one embodiment, multiple continuous plastic food bags 1 have a perforation 6, 6*a* in order to detach the plastic food bags 1 from one another. If the plastic food bags 1 have handles 4, the perforation 6 is only in the area of the handles 4. If the plastic food bags 1 do not have handles and stick to each other along the full width of the plastic food bags 1, the perforation 6, 6*a* is along the full width of the plastic food bag 1. According to one embodiment, the plastic food bags have small side walls which are folded between the side edges of the plastic food bags and may be unfolded by a user in order to form the plastic food bag. According to one embodiment, plastic food bags 1 have a zipper 7 if the plastic food bags 1 do not have handles 4. Zipper 7 is along the open side of the plastic food bags 1 along perforation 6. Zipper 7 is moved back and forth along an upper edge of the plastic food bags 1 (parallel to perforation 6) to open and close the plastic food bags 1.

Figure 2A:
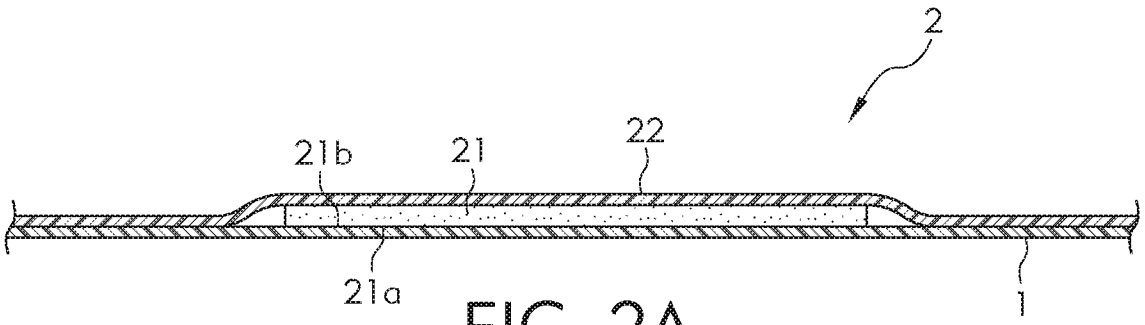
FIG. 2A schematically depicts a printable area for direct thermal printing according to the invention.
Figure 2B:
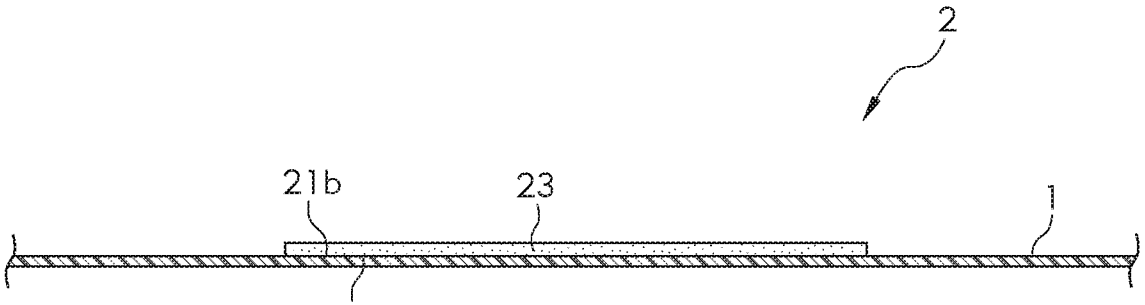
FIG. 2B schematically depicts a printable area for thermal transfer printing or ink jet printing according to the invention.

FIG. 2 illustrates the printing area 2 which is attached to the plastic food bag 1. In FIG. 2A, a printing area 2 for direct thermal printing is shown. The material of the plastic food bag 1 is partly covered by a thermosensitive material 21. This thermosensitive material 21 forms the printing area 2. If heat is applied to a part of the thermosensitive material 21, this part changes its color, e.g. to black. Thus a printhead applies heat to a specific area of the printing area 2 and therefore prints information to the printable area 2. A cover layer 22 is provided to protect the thermosensitive material. Cover layer 22 may be transparent. According to one embodiment, a base layer 21*a* which provides a background color is included in the printing area 2 between the thermosensitive material 21 and the plastic foil of the plastic food bag 1. In FIG. 2B, a printing layer 23 for thermal transfer printing or ink jet printing is schematically illustrated. During printing, either ink or color from a thermal transfer ribbon is applied to the upper surface of the printing layer 23 by a printhead. In each case, the printing layer 23 is directly applied to the plastic foil of the plastic food bag 1 or is even integrated directly into the plastic foil of the plastic food bag 1. According to one embodiment, a base layer 21*a* which provides a background color is included in the printing area 2 between the printing layer 23 and the plastic foil of the plastic food bag 1. The base layer 21*a* may include a base coat 21*b*.

Figure 3:
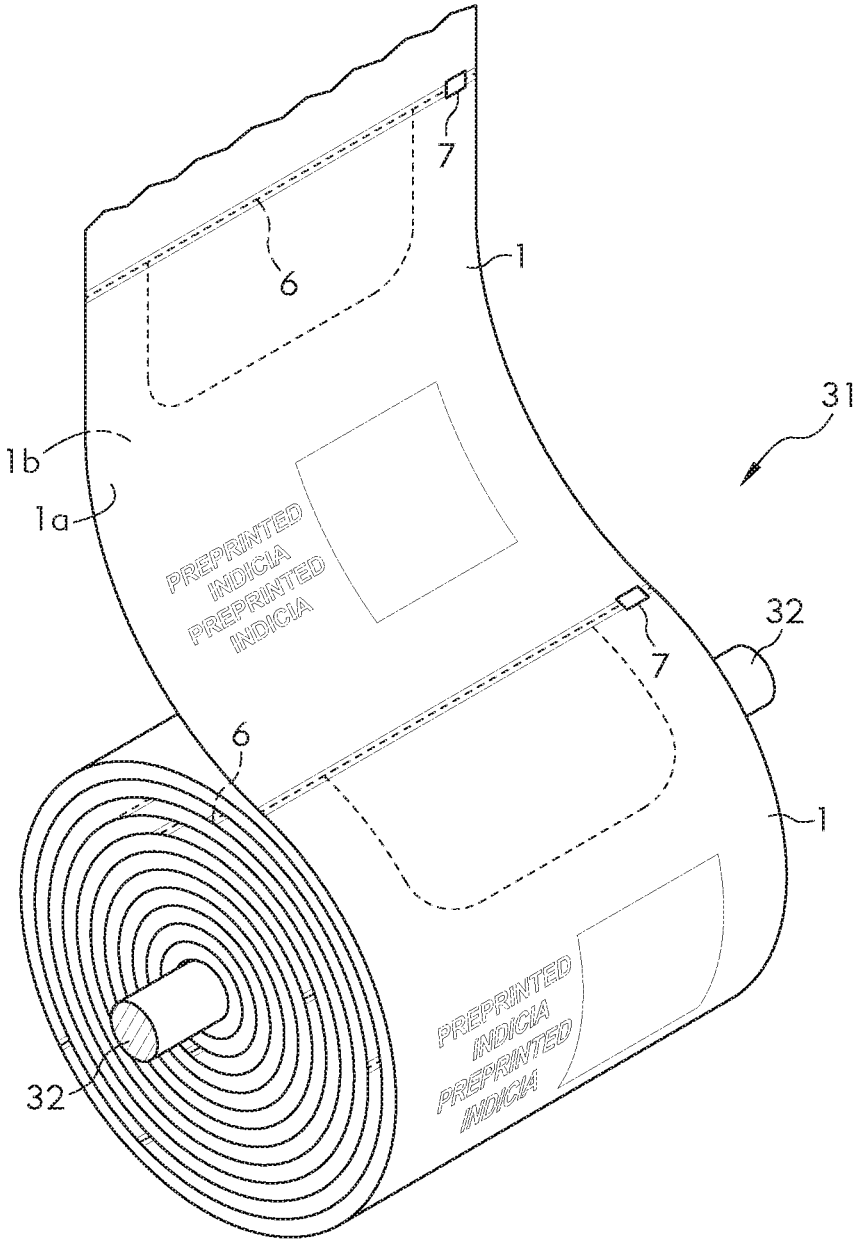
FIG. 3 schematically depicts a roll of continuous plastic food bags.

With regard to continuous plastic food bags 1 as depicted in FIG. 1 and as described above, the plastic food bags 1 according to one embodiment are coiled up as a roll 31 of continuous plastic food bags 1 as shown in FIG. 3. The roll 31 of plastic food bags 1 has a support element, e.g. a cylinder 32, in its center. If the roll 31 is installed in a printing apparatus in a plastic food bag holder, the cylinder 32 of the roll 31 is put in the holder to carry it. Plastic food bag 1 includes a first foil 1*a*, a second foil 1*b*, and a zipper 7.

Figure 4A:
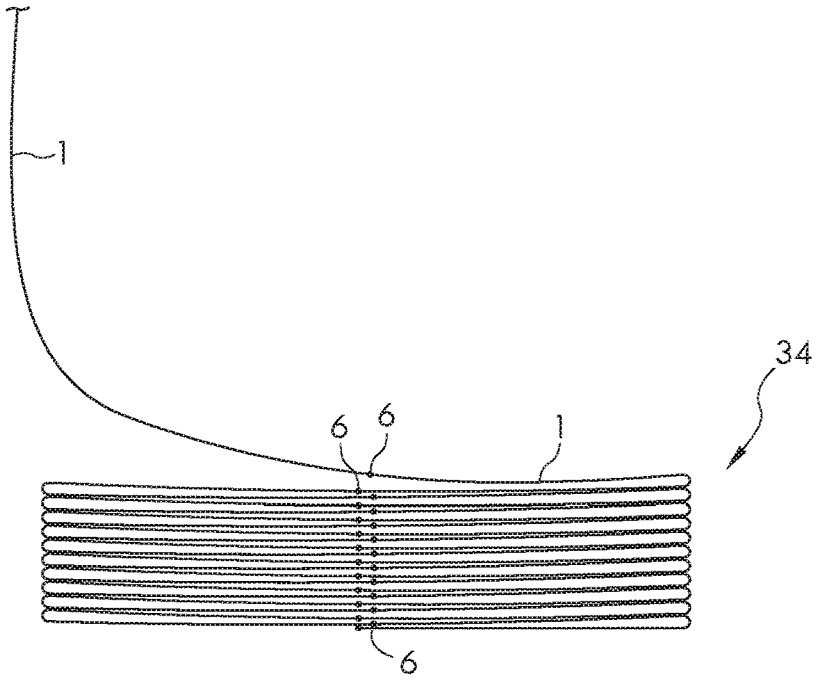
FIG. 4A schematically depicts zig-zag folded continuous plastic food bags according to one embodiment of the invention.
Figure 4B:
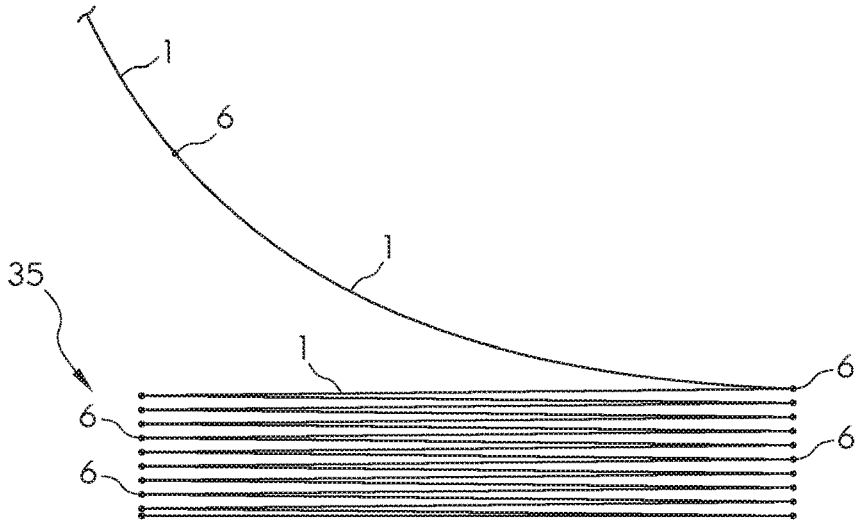
FIG. 4B schematically depicts zig-zag folded continuous plastic food bags according to another embodiment of the invention.

According to another embodiment, the continuous plastic food bags 1 are zig-zag folded as a block 34, 35 of multiple plastic food bags 1 as depicted in FIGS. 4A and 4B. In FIG. 4A, the perforation 6 between two continuous plastic food bags 1 is in the middle of the block 34 such that each plastic food bag 1 is folded in its middle part. According to FIG. 4B, the plastic food bags 1 are folded at or close to their perforations 6. As explained in more detail below, the blocks 34, 35 of plastic food bags 1 according to FIGS. 4A and 4B are fed into a printing apparatus and carried by a plastic food bag holder. The printing apparatus pulls the continuous plastic food bags 1 and unfolds the block 34, 35 of plastic food bags 1 during the printing process.

Figure 5A:
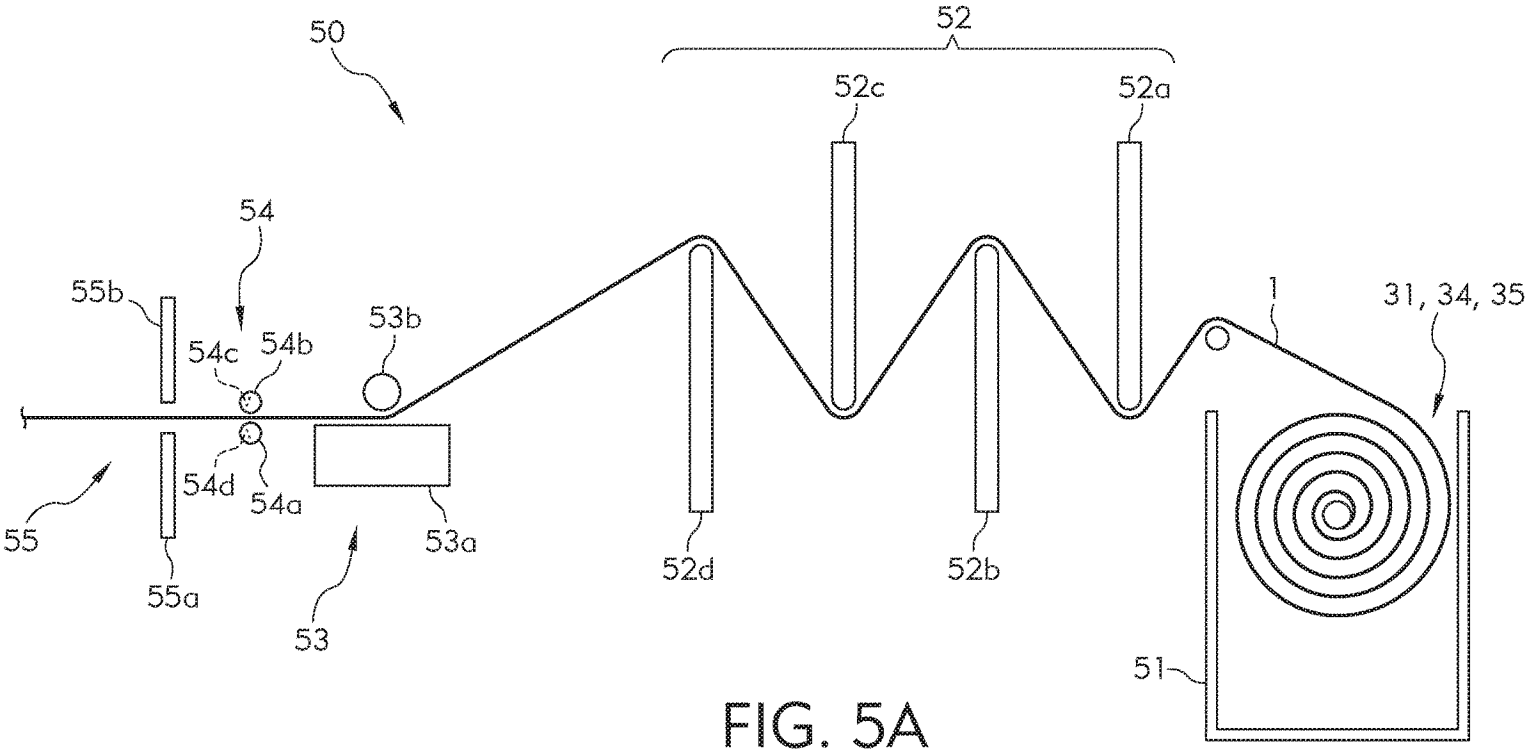
FIG. 5A schematically depicts a side view of a plastic food bag printing apparatus.
Figure 5B:
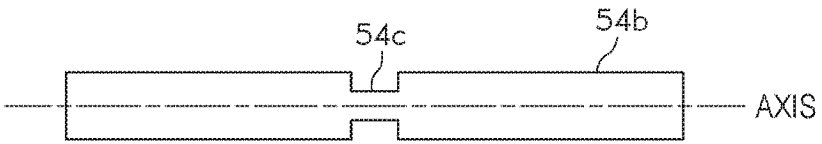
FIG. 5B schematically depicts a front view of one embodiment of a feed roller of the plastic food bag printing apparatus of FIG. 5A.

FIG. 5A shows a schematic view of a printing apparatus according to the invention. The printing apparatus 50 comprises a plastic food bag holder 51, which carries continuous plastic food bags 1 on a roll 31 or as a block 34, 35 as described above. The plastic food bags 1 are fed through a plastic food bag guiding mechanism 52. The plastic food bag guiding mechanism 52 comprises a plurality of guide walls 52*a*, 52*b*, 52*c*, 52*d*, which are arranged and neighboring each other in a feeding direction of the plastic food bags 1 in the order of upper wall 52*a*, lower wall 52*b*, upper wall 52*c* and lower wall 52*d*. Therefore, the continuous plastic food bags 1 are fed through the plastic food bag guiding mechanism 52 in an 'S' shaped manner. This helps to align the plastic food bags 1 and to avoid jams. One of ordinary skill in the art will understand that the four guide walls 52*a*, 52*b*, 52*c*, 52*d* shown in FIG. 5A are for illustrative purposes and that a larger or smaller number of guide walls could be employed, for example, such as three or five guide walls, as long as the 'S' shaped manner of guiding the continuous plastic food bags 1 through the plastic food bag guiding mechanism is maintained. The printing apparatus 50 also comprises a plastic food bag printer 53. The plastic food bag printer 53 comprises a printhead 53*a* and a guide roller 53*b*. According to one embodiment, the guide roller 53*b* is a driven roller. The guide roller 53*b* guides and pushes the plastic food bags 1 towards the printhead 53*a*. The printing apparatus 50 also comprises a plastic food bag transporting mechanism 54 comprising at least two feed rollers 54*a*, 54*b*. At least one of the two feed rollers 54*a*, 54*b* is driven. The plastic food bag transporting mechanism 54 pulls the continuous plastic food bags 1 from the plastic food bag holder 51 through the plastic food bag guiding mechanism 52 in the direction of the plastic food bag printer 53. The plastic food bag transporting mechanism 54 pushes the printed plastic food bags 1 towards a plastic food bag ejector 55, which comprises lower part 55*a* and upper part 55*b*. Each of the two feed rollers 54*a*, 54*b* may contain a notch 54*c*, 54*d*, respectively, for passing through the plastic food bag locking mechanism, e.g., zipper 7, which keeps the plastic food bag locking mechanism at the right position when passing the notches 54*c*, 54*d*. Notches 54*c*, 54*d* may be located along longitudinal axes of feed rollers 54*b*, 54*a*, respectively, such that notches 54*c*, 54*d* do not extend along an entire length of the longitudinal axes of feed rollers 54*b*, 54*a*, respectively, as shown in FIG. 5B. According to one embodiment, the plastic food bag ejector 55 comprises a knife for detaching plastic food bags 1 at perforations 6 or elsewhere, in that one or both of lower part 55*a* and upper part 55*b* includes a sharpened edge for separating the plastic food bags 1 from one another.

Figure 6A:
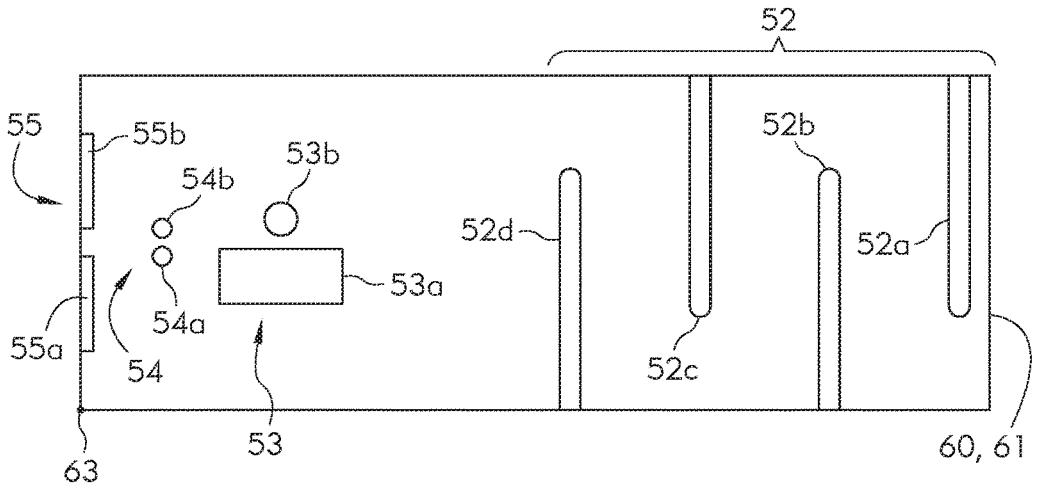
FIG. 6A schematically depicts a side view of one embodiment of the printing apparatus while in an operational mode.
Figure 6B:
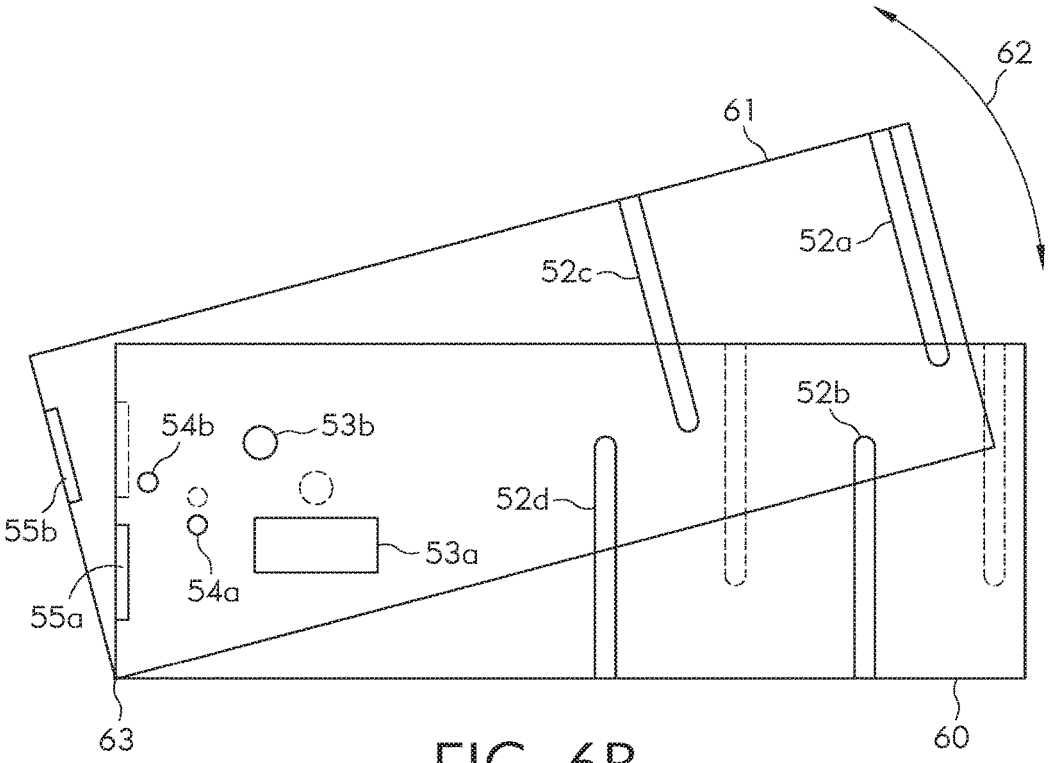
FIG. 6B schematically depicts a side view of the printing apparatus of FIG. 6A while in an installation mode.

In order to install the plastic food bags 1 in the printing apparatus, the plastic food bag guiding mechanism 52, the plastic food bag printer 53, the plastic food bag transporting mechanism 54 and the plastic food bag ejector 55 may be mounted on a clamshell device 60, 61. FIG. 6A shows one embodiment of the printing apparatus in an operational mode with the clamshell device 60, 61 closed, while FIG. 6B shows the printing apparatus in an installation mode with the clamshell device 60, 61 open. The clamshell device comprises lower clamshell 60 and upper clamshell 61. The upper clamshell 61 can include, for example, the first upper wall 52*a*, the second upper wall 52*c*, the guide roller 53*b*, the first feed roller 54*b* and an upper part 55*b* of the plastic food bag ejector 55. The clamshell device 60, 61 can be opened and closed around its fixing point 63 in the direction of the arrow 62. The lower clamshell 60 can include, for example, the first lower wall 52*b*, the second lower wall 52*d*, the printhead 53*a*, the first feed roller 54*a* and the lower part 55*a* of the plastic food bag ejector 55.

Clamshell device 60, 61 may have other configurations. According to one embodiment, the fixing point 63 of the clamshell device 60, 61 may be, for example, at the upper right corner of the clamshell device 60, 61. In another embodiment, the fixing point 63 may not be exactly at a corner of the clamshell device 60, 61 but only close to a corner.

Figure 7A:
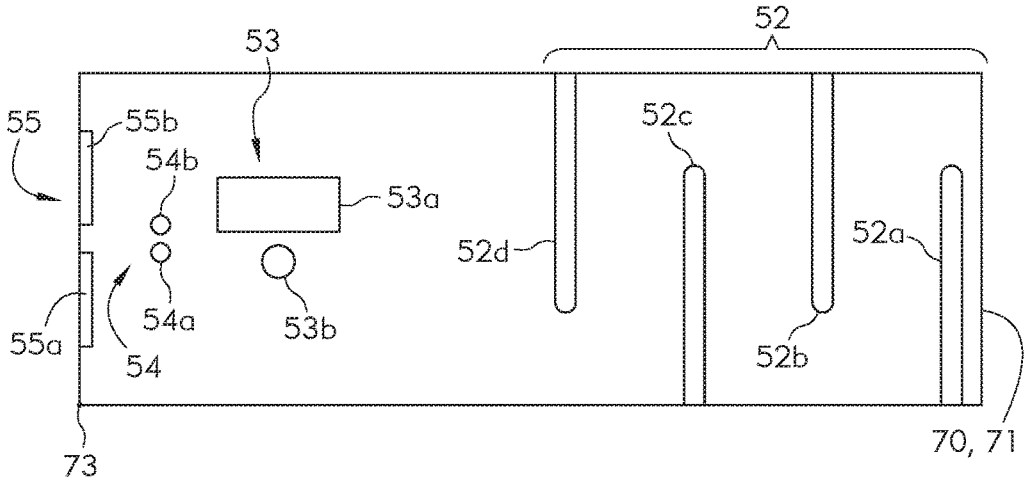
FIG. 7A schematically depicts a side view of another embodiment of the printing apparatus while in an operational mode.
Figure 7B:
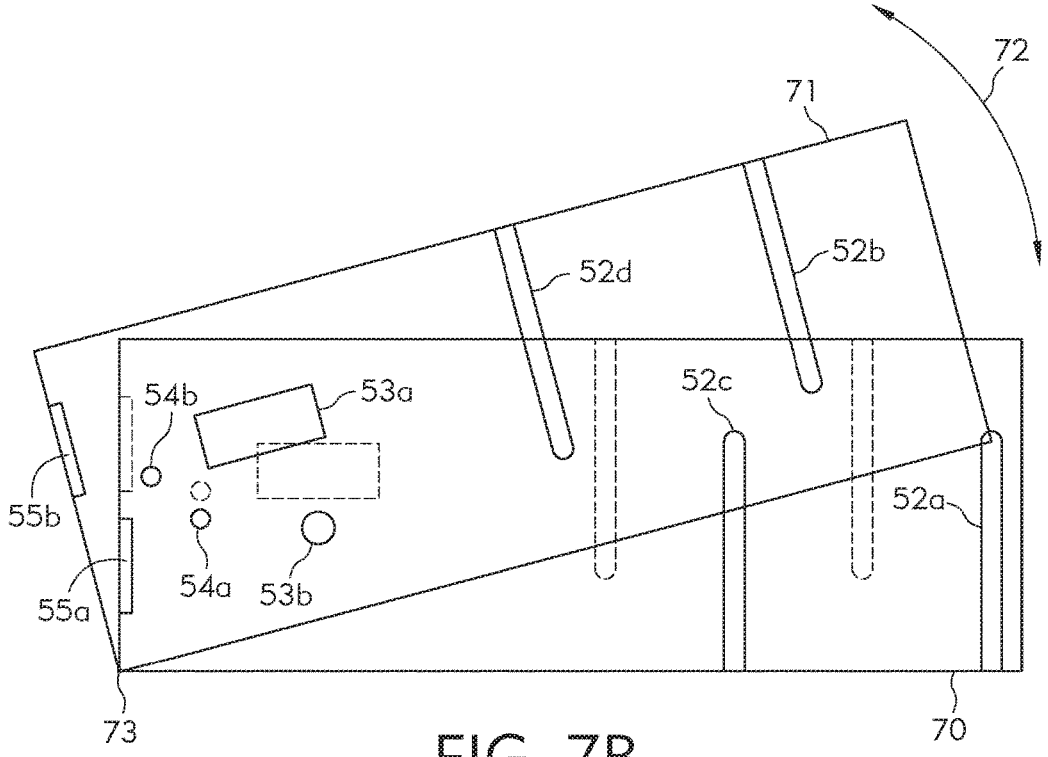
FIG. 7B schematically depicts a side view of the printing apparatus of FIG. 7A while in an installation mode.

FIGS. 7A and 7B show another embodiment of the invention. The plastic food bag guiding mechanism 52, the plastic food bag printer 53, the plastic food bag transporting mechanism 54 and the plastic food bag ejector 55 are shown. In contrast with FIGS. 6A and 6B, in FIGS. 7A and 7B the orientation of the lower and upper walls of the plastic food bag guiding mechanism 52 are flipped, and the printhead 53*a* is installed above the guide roller 53*b*. The clamshell device comprises lower clamshell 70 and upper clamshell 71. The clamshell device 70, 71 can be opened and closed around its fixing point 73 in the direction of the arrow 72. While in the printing apparatus shown in FIGS. 6A and 6B the printable area 2 would be disposed on a lower side of the plastic food bags 1 and the printhead 53*a* would be disposed below the plastic food bags 1, in FIGS. 7A and 7B the printable area 2 of the plastic food bags 1 would be disposed on an upper side of the plastic food bags 1. The orientation of FIGS. 6A and 6B or the orientation of FIGS. 7A and 7B can be selected based on the side on which the printable area 2 is integrated in the plastic food bag 1. According to one embodiment, both possibilities are combined and a first printhead is installed for printing on the top side of the plastic food bags 1 followed by a second printhead for printing on the bottom side of the plastic food bag 1 or vice versa. In case direct thermal printing is used, the printable area 2 on the top side of the plastic food bag 1 and the printable area 2 on the bottom side of the plastic food bag 1 must not overlap, in order that one printhead does not influence the printable area 2 assigned to the other printhead.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A printing apparatus for printing on continuous plastic food bags, each of the continuous plastic food bags containing a printable area integrated in a plastic foil thereof, the printer apparatus comprising:

a plastic food bag holder for holding the continuous plastic food bags;

a plastic food bag guiding mechanism for guiding the continuous plastic food bags from the plastic food bag holder in the direction of a plastic food bag printer, the plastic food bag printer comprising a printhead configured for direct thermal printing onto the printable area of each of the continuous plastic food bags;

a plastic food bag transporting mechanism for pulling the continuous plastic food bags through the plastic food bag guiding mechanism towards the plastic food bag printer; and a plastic food bag ejector configured to detach an individual plastic food bag from the continuous plastic food bags, wherein the plastic food bag guiding mechanism comprises at least two guide walls along a feeding direction of the continuous plastic food bags, the at least two guide walls being displaced with respect to one another in a direction perpendicular to the feeding direction, and wherein the at least two guide walls comprise a first and a second upper guide wall and a first and a second lower guide wall that are disposed in order in the feeding direction as the first upper wall, the first lower wall, the second upper wall, and the second lower wall, wherein the printhead and the guide roller are disposed after the second lower wall in the feeding direction, and wherein the printhead is disposed below the guide roller.

2. The printing apparatus according to claim 1, wherein each of the continuous plastic food bags comprises:

a first plastic foil, and a second plastic foil, wherein the first foil and the second foil are disposed adjacent to one another and are continuously merged together at three edges to form the plastic food bag, wherein the first foil contains a printable area, the printable area comprising at least a cover layer and a middle layer comprising a thermosensitive material that changes color when heated, and wherein the printable area is configured to be printable by the printhead after the forming of the plastic food bag.

3. The printing apparatus according to claim 1, wherein the plastic food bag transporting mechanism comprises at least a first feed roller and a second feed roller, at least one of the first feed roller and the second feed roller being driven, the first feed roller and second feed roller being configured to press against one another to pull the continuous plastic food bags through the plastic food bag guiding mechanism and through the plastic food bag printer, and being further configured to push the continuous plastic food bags towards the plastic food bag ejector.

4. The printing apparatus according to claim 3, wherein at least one of the first feed roller or the second feed roller contains a notch configured to receive a locking mechanism of each of the continuous plastic food bags.

5. The printing apparatus according to claim 1, wherein the plastic food bag printer comprises:

a guide roller configured to guide the continuous plastic food bags towards the printhead.

6. The printing apparatus according to claim 5, wherein the guide roller is a driven roller.

7. The printing apparatus according to claim 1, wherein the plastic food bag guiding mechanism, the plastic food bag transporting mechanism, and the printhead are disposed on a clamshell device that has an upper part and a lower part, wherein the upper part includes the first upper wall, the second upper wall, the guide roller, and a first feed roller, and wherein the lower part includes the first lower wall, the second lower wall, the printhead, and a second feed roller.

8. The printing apparatus according to claim 1, wherein the continuous plastic food bags comprise multiple plastic food bags attached to each other to form a strip of plastic food bags, and wherein the plastic food bags are detachable from each other by a perforation therebetween.

9. The printing apparatus according to claim 8, wherein the continuous plastic food bags are coiled on a roll.

10. The printing apparatus according to claim 8, wherein the continuous plastic food bags are zig-zag folded as a block.

11. The printing apparatus according to claim 1, wherein the plastic food bag printer is configured to print at least one of a store address, a store logo, marketing information, a bar code, a price, a weight, or ingredients for one or multiple items to be packed in the plastic food bag on the printable area of the plastic food bag.

12. A printing apparatus for printing on continuous plastic food bags, each of the continuous plastic food bags containing a printable area integrated in a plastic foil thereof, the printer apparatus comprising:

a plastic food bag holder for holding the continuous plastic food bags;

a plastic food bag guiding mechanism for guiding the continuous plastic food bags from the plastic food bag holder in the direction of a plastic food bag printer, the plastic food bag printer comprising a printhead configured for direct thermal printing onto the printable area of each of the continuous plastic food bags;

a plastic food bag transporting mechanism for pulling the continuous plastic food bags through the plastic food bag guiding mechanism towards the plastic food bag printer; and a plastic food bag ejector configured to detach an individual plastic food bag from the continuous plastic food bags, wherein the plastic food bag guiding mechanism comprises at least two guide walls along a feeding direction of the continuous plastic food bags, the at least two guide walls being displaced with respect to one another in a direction perpendicular to the feeding direction, and wherein the at least two guide walls comprise a first and a second upper guide wall and a first and a second lower guide wall that are disposed in order in the feeding direction as the first lower wall, the first upper wall, the second lower wall, and the second upper wall, wherein the printhead and the guide roller are disposed after the second upper wall in the feeding direction, and wherein the printhead is disposed above the guide roller.

13. The printing apparatus according to claim 12, wherein each of the continuous plastic food bags comprises:

a first plastic foil, and a second plastic foil, wherein the first foil and the second foil are disposed adjacent to one another and are continuously merged together at three edges to form the plastic food bag, wherein the first foil contains a printable area, the printable area comprising at least a cover layer and a middle layer comprising a thermosensitive material that changes color when heated, and wherein the printable area is configured to be printable by the printhead after the forming of the plastic food bag.

14. The printing apparatus according to claim 12, wherein the plastic food bag transporting mechanism comprises at least a first feed roller and a second feed roller, at least one of the first feed roller and the second feed roller being driven, the first feed roller and second feed roller being configured to press against one another to pull the continuous plastic food bags through the plastic food bag guiding mechanism and through the plastic food bag printer, and being further configured to push the continuous plastic food bags towards the plastic food bag ejector.

15. The printing apparatus according to claim 14, wherein at least one of the first feed roller or the second feed roller contains a notch configured to receive a locking mechanism of each of the continuous plastic food bags.

16. The printing apparatus according to claim 12, wherein the plastic food bag printer comprises:

a guide roller configured to guide the continuous plastic food bags towards the printhead.

17. The printing apparatus according to claim 16, wherein the guide roller is a driven roller.

18. The printing apparatus according to claim 12, wherein the plastic food bag guiding mechanism, the plastic food bag transporting mechanism and the printhead are disposed on a clamshell device that has an upper part and a lower part, wherein the upper part includes the first upper wall, the second upper wall, the printhead, and a first feed roller, and wherein the lower part includes the first lower wall, the second lower wall, the guide roller, and a second feed roller.

19. The printing apparatus according to claim 12, wherein the continuous plastic food bags comprise multiple plastic food bags attached to each other to form a strip of plastic food bags, and wherein the plastic food bags are detachable from each other by a perforation therebetween.

20. The printing apparatus according to claim 19, wherein the continuous plastic food bags are coiled on a roll.

21. The printing apparatus according to claim 19, wherein the continuous plastic food bags are zig-zag folded as a block.

22. The printing apparatus according to claim 12, wherein the plastic food bag printer is configured to print at least one of a store address, a store logo, marketing information, a bar code, a price, a weight, or ingredients for one or multiple items to be packed in the plastic food bag on the printable area of the plastic food bag.

* * * * *